US007360562B1

(12) United States Patent
Hindmarsh

(10) Patent No.: US 7,360,562 B1
(45) Date of Patent: Apr. 22, 2008

(54) CABLE TIE APPARATUS

(76) Inventor: Walter Hindmarsh, 42 Lexington Ave., Florence, MA (US) 01062

( * ) Notice: Subject to any disclaimer, the term of this patent is extended or adjusted under 35 U.S.C. 154(b) by 221 days.

(21) Appl. No.: 11/337,737

(22) Filed: Jan. 23, 2006

Related U.S. Application Data

(60) Provisional application No. 60/653,463, filed on Feb. 16, 2005.

(51) Int. Cl.
*B21F 9/02* (2006.01)

(52) U.S. Cl. ..... 140/93.2

(58) Field of Classification Search ..... 140/93.2, 140/93.6, 123.5, 123.6; 29/278; 248/74.2, 248/74.3; 24/16 PB, 484, 16 R; 292/318, 292/319

See application file for complete search history.

(56) References Cited

U.S. PATENT DOCUMENTS 3,014,506 A * 12/1961 Crimmins et al. ..... 140/93.2
3,621,889 A * 11/1971 Hidassy ..... 140/93.2
5,050,649 A * 9/1991 Kurmis ..... 140/93 A
5,915,424 A * 6/1999 Franks et al. ..... 140/92.1
7,284,731 B1 * 10/2007 Johnson et al. ..... 248/74.4

* cited by examiner

*Primary Examiner*—Ed Tolan
(74) *Attorney, Agent, or Firm*—Salter & Michaelson

(57) ABSTRACT

A cable tie fastening apparatus or device for securing the ends of a cable or wire tie device or the like. This device includes a pair of cable tie holders for retaining the free and head cable tie ends, a flexible base member connecting the cable tie holders, a cable tie lock for securing the respective lock end of the cable tie, a pawl construction for unidirectionally engaging the free end of the cable tie, a pair of grips disposed on opposite sides of the flexible connection and a cable tie guide adjacent the head end cable tie holder for receiving the free end of the cable or wire tie.

20 Claims, 2 Drawing Sheets

CABLE TIE APPARATUS

RELATED APPLICATIONS

The present application claims priority to U.S. Provisional Application Ser. No. 60/653,463 filed on Feb. 16, 2005.

TECHNICAL FIELD

The present invention relates to a device or apparatus for securing the ends of a cable or wire tie device or the like. The present invention relates more particularly to a simplified hand-held cable tie securing apparatus.

BACKGROUND OF THE INVENTION

Cable or wire tie devices are generally known in the art, and typically comprise an elongated molded plastic strap having a head or locking end and an opposite, tail or free end. The free end of the elongated strap is for sliding through an opening in the head end, with a pawl arrangement for engaging a succession of serrated teeth formed along the length of the free end of the strap to accommodate unidirectional engagement which prevents strap withdrawal through the head end opening. With this construction, the free end of the strap can be wrapped about one or more elongated components such as a plurality of conductive wires, tubes or the like, and then drawn through the head end opening for securely retaining the components.

It is known in the prior art to provide installation tools for cable or wire tie devices. These tools assist in feeding the free end of a cable tie through its associated head or locking end and cinch the closed loop cable tie around the desired bundle, object or the like. For an example of a typical prior art installation tool see U.S. Pat. No. 6,497,258. Some of the problems associated with existing installation tools are that they are large, complex in construction, not portable, and expensive to manufacture. Most of these installation tools are motor-driven and thus are not made for manual use Also, these existing installation tools are not readily adapted for use in the field. Moreover, there is a need in the art to provide an installation tool for use in space-restricted areas. This would be particularly advantageous where using both hands to fasten the cable or wire tie device is not feasible.

Accordingly, it is an object of the present invention to provide an improved wire or cable tie installation apparatus that is relatively simple in construction, is readily usable in the field, and is meant for manual use.

Another object of the present invention is to provide a portable wire tie securing device that is small in size and can be readily used in a hand-held manner.

SUMMARY OF THE INVENTION

To accomplish the foregoing and other objects, features and advantages of the present invention there is provided a cable tie apparatus that is comprised of a cable tie lock for securing the lock or head end of the cable tie; a pair of cable tie holders for retaining the respective free and head cable tie ends; a flexible base member connecting the cable tie holders; a pair of grips disposed on opposite sides of the flexible base member; a pawl construction for unidirectionally engaging the free end of the cable tie; and a cable tie guide adjacent the lock end cable tie holder for receiving the free end of the cable tie.

In accordance with other aspects of the present invention the cable tie lock preferably holds the lock end of the cable tie securely in place; the pair of cable tie holders may each have an opening for receiving the cable tie; the pair of grips may extend respectively from the pair of cable tie holders; the pair of grips may be molded to encompass a thumb or finger; the pawl construction preferably includes a pawl finger having one end fastened to the cable tie holder, and another free end that engages the cable tie unidirectionally; the cable tie guide is may be attached to the cable tie holder that secures the lock end of the cable tie and the cable tie guide preferably has a slot that gradually decreases in size toward the lock end of the cable tie.

In accordance with other embodiments of the present invention there is provided a device for securing together the head and tail ends of a cable tie. This device comprises a flexible arc-shaped base member; a head end holder for receiving the head end of the cable tie and disposed at one end of the arc-shaped base member; a tail end holder for receiving the tail end of the cable tie and disposed at an opposite end of the arc-shaped base member; and means for gripping the flexible arc-shaped base member to enable opening and closing thereof; with the head end holder including means for holding the head end of the cable tie in place as the base member is moved between open and closed positions.

In accordance with other aspects of the present invention the device preferably has both holders with an elongated slot for receiving the cable tie; the head end holder preferably has a straight slot and the tail end holder preferably has an arcuate slot; means for gripping may comprise oppositely disposed grips on opposite sides of the base member; further including a unidirectional engagement member supported by the tail end holder for engagement with grooves of the cable tie for the purpose of advancing the cable tie; and the unidirectional engagement member may comprise a pawl finger.

In accordance with still other embodiments of the present invention there is provided a device for securing together the head and tail ends of a cable tie, comprising a flexible arc-shaped base member; a head end holder for receiving the head end of the cable tie and disposed at one end of the arc-shaped base member; a tail end holder for receiving the tail end of the cable tie and disposed at an opposite end of the arc-shaped base member; and means for gripping the flexible arc-shaped base member to enable opening and closing thereof; with the holders each comprising an open slotted structure for holding the cable tie while enabling removal therefrom once secured.

In accordance with other aspects of the present invention the device preferably has the head end holder with a slot for allowing the tail end of cable tie to pass through the holder; the head end holder preferably includes means for holding the head end of the cable tie in place as the base member is moved between open and closed positions; the tail end holder preferably has a slot for allowing the tail end of the cable tie to pass through the holder; the means for gripping the flexible arc-shaped base member is able to encompass a finger or thumb and the means for holding the head end of the cable tie in place on the head end holder prevent the head end from passing through the slot in the holder.

BRIEF DESCRIPTION OF THE DRAWINGS

Numerous other objects, features and advantages of the present invention should now become apparent upon a reading of the following detailed description taken in conjunction with the accompanying drawings, in which.

DETAILED DESCRIPTION

Figure 4:
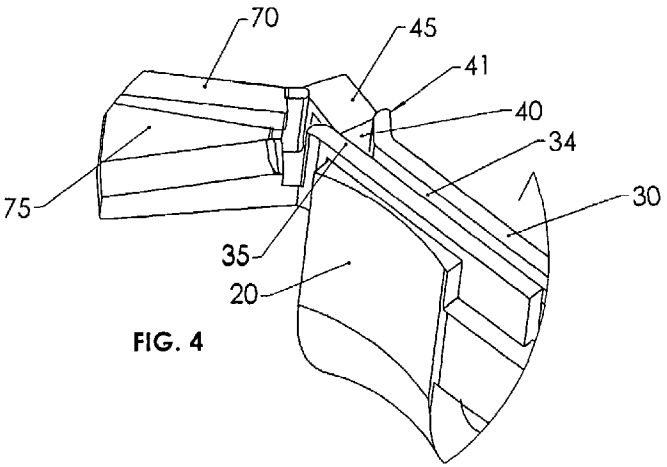
FIG. 4 is an enlarged fragmentary view of the cable tie guide and the secured head end of the cable tie as shown in FIG. 3.

Referring now to the drawings, a preferred embodiment of the present invention is illustrated in FIGS. 1-8. The apparatus includes a flexible arc-shaped base 50; a pair of holders 30 and 31 for the cable tie 55; a lock end 40 for holding the head end 45 of the cable tie; a pair of grips 20 and 21 for opening and closing the apparatus; a pawl mechanism 60 for unidirectionally advancing the free or tail end 65 of the cable tie 55 by engaging with the grooves 64 of the cable tie; and a cable tie guide 70 for receiving the free or tail end 65 of the cable tie 55.

Figure 3:
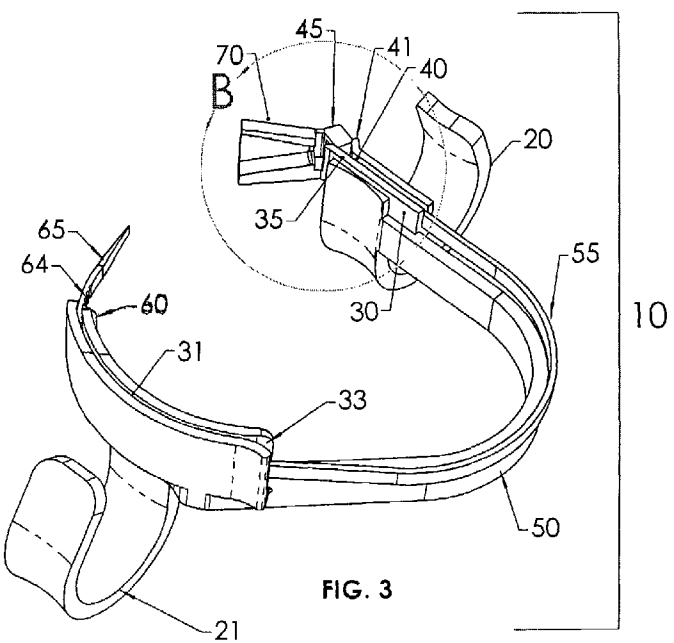
FIG. 3 is a perspective view of the apparatus in its open position, directed at the head end of the cable tie.
Figure 1:
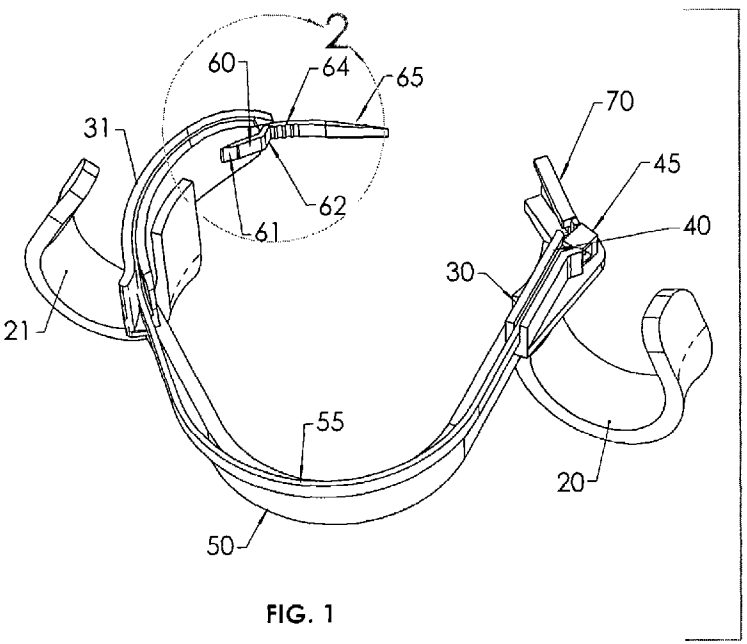
FIG. 1 is a perspective view of the apparatus in its open position, directed at the free end of the cable tie.

FIGS. 1 and 3 are perspective views of the cable tie apparatus 10 in its open position. The flexible arc-shaped base 50 is constructed to enable various lengths and widths of cable or wire ties to be used with this apparatus. The base 50 is preferably comprised of a molded flexible plastic, however it is not limited to plastic; and other materials such as spring steel may be used. The two holders 30 and 31 are disposed at opposite ends of the base 50. The holders 30 and 31 are preferably form-molded with the arc-shaped base 50. Preferably the holder 30 and its associated slot 34 are relatively straight, as illustrated. Preferably the holder 31 and its associated slot 33 are in an arcuate shape, as illustrated.

One holder 30 receives the head end 45 of the cable tie 55 and one holder 31 receives the free end 65 of the cable tie 55. The holder 30 has an elongated slot 34 for receiving the head end 45 of the cable or wire tie, while the holder 31 has an elongated slot 33 for receiving the tail end 65 of the cable or wire tie. The slots 33 and 34 not only retain the cable tie to enable fastening, but also allow release of the cable tie once fastened to the desired closure length. The slots 33 and 34 are preferably constructed so as to provide a snug fit for the cable or wire tie strap. This assists in holding the strap in place. Although this is a snug fit, it still readily allows withdrawal of the cable or wire tie, once closed. The walls forming the slots 33 and 34 preferably have some flexibility side to side so as to accommodate wire ties of different strap thickness. The walls defining the slots 33 and 34 may be tapered so that they are closer together at the top of the slot.

Finger and/or thumb grips 20 and 21, as illustrated in FIGS. 1, 3, 5 and 7 are disposed on opposite sides of the base 50. Each of these grips 20 and 21 are sized to receive a finger or thumb and in the illustrated embodiment are secured at the area of the holders 30 and 31 respectively. The grips 20 and 21 enable the opening and closing of the apparatus, which enables the fastening of the cable or wire tie, as will be described in further detail hereinafter. These grips are preferably a molded flexible material so as to enable various sizes of fingers and/or thumbs to be able to fit within the grips. In an alternate embodiment these grips may be closed rather than open, as illustrated, or other finger/thumb retainers may be used such as ones using Velcro as a fastener. Also, although the grips are shown at a particular location in FIG. 5, it is understood that the grips could be shown at other locations along the base member, or alternatively a single grip could be used. Also, the grips do not need to be in the form shown, they could also be constructed of other materials, such as the use of Velcro loops or enclosed plastic loops or slots.

Figure 2:
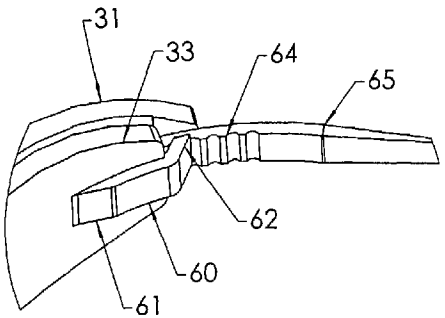
FIG. 2 is an enlarged fragmentary view of the pawl construction as shown in FIG. 1 at the free end of the cable tie.

The free end 65 of the cable tie is advanced by the pawl finger 60 which includes two ends: one end 61 attached to the holder 31 adjacent to the output end of the slot 33, and another free end 62 which is directed at the slot 33 and engages uni-directionally. The pawl end 62 has a tip that engages the grooves 64, as shown in FIG. 2. This essentially holds the tail end in the holder 31 preventing it from moving backwards in the holder slot 33. The end 62 can move in the opposite direction, sliding back over the grooves when the tail 65 is engaged with the head 45 and when the apparatus is opened. Thus, by engaging the pawl with the grooves 64 in the free or tail end 65 of the cable tie it is essentially locked in position, but once the cable tie is secured the pawl can move rearwardly over the grooves until it is positioned at another groove for a subsequent cycle of closing. This is further illustrated in FIG. 2, which is an enlarged fragmentary view of the pawl arrangement.

Figure 8:
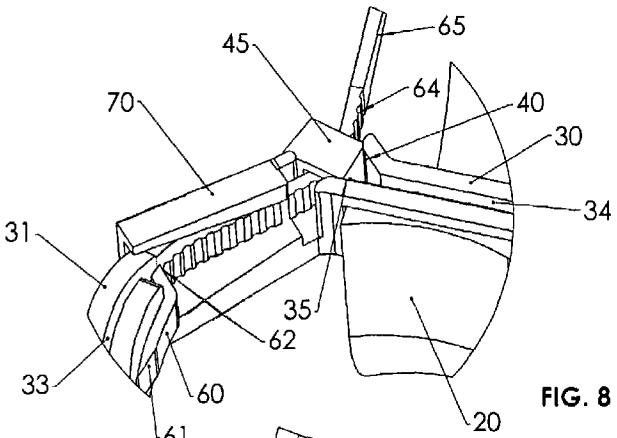
FIG. 8 is an enlarged fragmentary view of the cable tie passing through the head end, as shown in FIG. 7.
Figure 6:
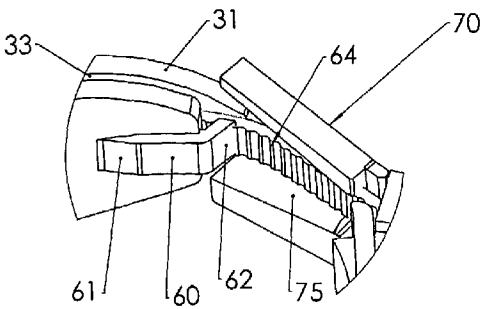
FIG. 6 is an enlarged fragmentary view of FIG. 5, showing the cable tie passing through the cable tie guide.

The head end 45 of the cable or wire tie is held in place by the lock end 40 of the holder 30. The lock end 40 is actually formed by the walls of the holder 30 that form the slot 34, particularly at the outer end where, as illustrated in FIG. 4, the outer wall is flared at 41 so as to receive and hold the head end 45 of the cable or wire tie. The lock end 40 of the holder prevents this head end 45 from passing through holder 30 and maintains the head end 45 of the cable or wire tie in a position, as illustrated in FIG. 8, adjacent to the cable tie guide 70. The head end 45 is also locked or retained by the placement of the guide 70 which is supported adjacent to the outlet side of the holder 30.

Cable tie guide 70 is a molded guide which includes slot 75, which decreases in width toward the head end of the cable tie, so as to facilitate guiding of the tail end 65 into the head end 45. This cable tie guide 70 at its fixed end is attached to wall 35 of holder 30 at a location where it does not interfere with the smooth transition of the tail end 65 into the head end 46 of the cable tie. The cable tie guide 70 may be connected by a pivot arrangement or by means of a flexible connection so as to enable the guide 70 to be at least partially moved out of the way so that the wire tie device can be lifted out, freeing the cable or wire tie. Refer also to FIG. 8 for a clear illustration of the tail end 65 passing through the guide 70 into the head end 45 of the cable tie.

Figure 7:
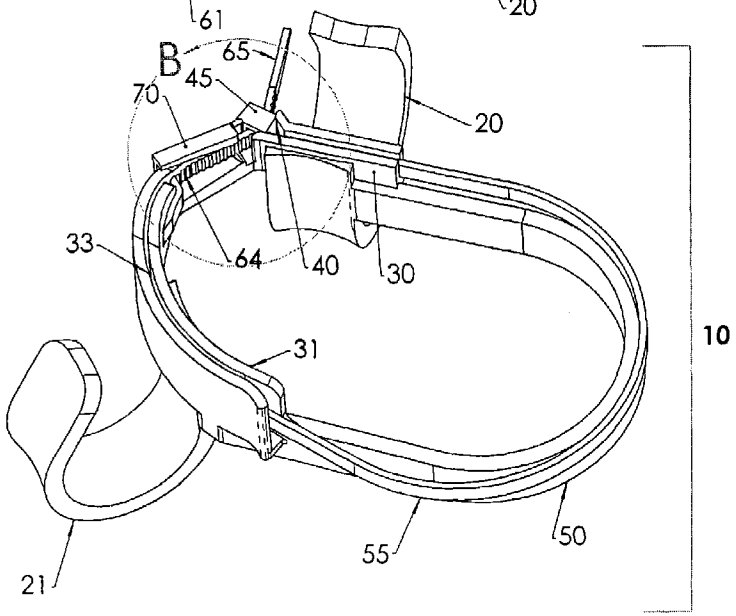
FIG. 7 is a perspective view of the apparatus in its closed state, directed at the fastening of the cable tie at the head end.
Figure 5:
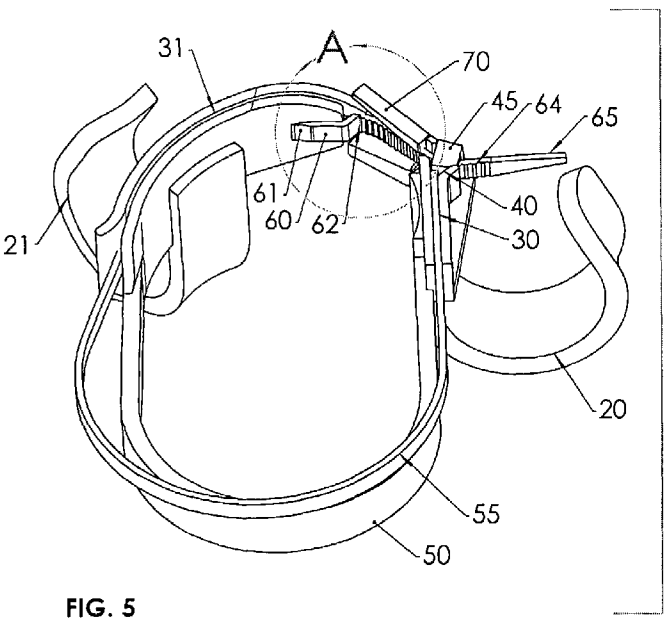
FIG. 5 is a perspective view of the apparatus in its closed position, directed at the pawl construction of the apparatus.

FIGS. 5 and 7 are perspective views of the apparatus in its closed position, directed at the pawl construction and the ratcheting of the cable tie, respectively. FIGS. 5 and 7 show the same apparatus as in FIGS. 1 and 3, with the exception that the apparatus is now in its closed position, and the ends of the cable or wire tie are being fastened together.

In reference to FIGS. 5-8, this illustrates the free end 65 of the cable tie as engaged with the cable guide 70 so as to be guided thereby to and for engagement with the head end 45 of the cable tie. The holder 31 enables the cable tie to pass directly to the pawl construction 60 via slot 33, and as the apparatus is closed, the pawl finger end 62 locks against the grooves 64 of the free end 65 of the cable or wire tie unidirectionally advancing the free end 65 into the head end 45. The apparatus is closed by virtue of the user engaging the grips 20 and 21 and closing the arc-shaped base 50 from a position as illustrated in FIGS. 1 and 3 toward a position as illustrated in FIGS. 5 and 7.

Once a certain number of grooves 64 have engaged with the head end 45, then the user can manually open the arc-shaped base 50. When the apparatus is then opened, the cable tie remains locked and the pawl end 62 slides back over the cable tie grooves 64 without affecting the cable tie strap. When the apparatus is again closed to further fasten the cable tie, the pawl end 62 again engages with the grooves 64 to further advance the free end 65 through the lock end 45 of the cable tie. Of course, these grooves are further down the length of the wire tie. This repeating process of opening and closing via the grips 20 and 21 continues until the wire or cable tie has closed sufficiently about the objects being grasped thereby. The sequence is thus characterized by a cyclic opening and closing by the operator grasping the grips 20, 21 and forcing the apparatus to flex, particularly by bending the base band 50 in a flexing manner. This action causes the tail end 65 to engage with the head end 45 and thereafter, on an "opening" stage causing the pawl 60 to slide over the grooves until at a full open position is reached, and then a re-engagement of the pawl with a groove to hold the tail end in place, followed by a subsequent "closing" stage to further engage the tail end with the head end causing a further closing of the wire tie loop.

When the cable or wire tie is fastened as so desired, the apparatus can simply be moved out of the way by releasing the cable guide 70 by moving it to the side. The slots 33 and 34 enable the cable tie to easily slide up and out of the apparatus, while being maintained about the objects being held together thereby.

Having thus described particular embodiments of the invention, various alterations, modifications and improvements will readily occur to those skilled in the art. Such alterations, modifications and improvements as are made obvious by this disclosure are intended to be a part of this description though not expressly stated herein, and are intended to be within the spirit and scope of the invention. Accordingly, the foregoing description is by way of example only, and not limiting. The invention is limited only as defined in the following claims and equivalents hereto.

What is claimed is:

1. A cable tie apparatus for a cable tie that has a head end and a free end, comprising:

a cable tie lock for securing the head end of the cable tie;

a pair of cable tie holders for retaining the respective free and head cable tie ends;

a flexible base member connecting the cable tie holders;

a pair of grips disposed on opposite sides of the flexible base;

a pawl construction for unidirectionally engaging the free end of the cable tie; and a cable tie guide adjacent the head end cable tie holder for receiving the free end of the cable tie.

2. A cable tie apparatus as claimed in claim 1 wherein said cable tie lock holds the lock end of the cable tie securely in place.

3. A cable tie apparatus as claimed in claim 1 wherein said pair of cable tie holders each have an opening for receiving the cable tie.

4. A cable tie apparatus as claimed in claim 1 wherein said pair of grips extend respectively from the pair of cable tie holders.

5. A cable tie apparatus as claimed in claim 1 wherein said pair of grips are molded to encompass a thumb or finger.

6. A cable tie apparatus as claimed in claim 1 wherein said pawl construction includes a pawl finger having one end fastened to the cable tie holder, and another free end that engages the cable tie unidirectionally.

7. A cable tie apparatus as claimed in claim 1 wherein said cable tie guide is attached to the cable tie holder that secures the lock end of the cable tie.

8. A cable tie apparatus as claimed in claim 1 wherein said cable tie guide has a slot that gradually decreases in size toward the lock end of the cable tie.

9. A device for securing a cable tie that has head and tail ends, comprising:

a flexible arc-shaped base member;

a head end holder for receiving the head end of the cable tie and disposed at one end of the arc-shaped base member;

a tail end holder for receiving the tail end of the cable tie and disposed at an opposite end of the arc-shaped base member; and means for gripping the flexible arc-shaped base member to enable opening and closing thereof;

said head end holder including means for holding the head end of the cable tie in place as the base member is moved between open and closed positions.

10. A device as claimed in claim 9 wherein both said holders have an elongated slot for receiving the cable tie.

11. A device as claimed in claim 10 wherein said head end holder has a straight slot and said tail end holder has an arcuate slot.

12. A device as claimed in claim 9 wherein said means for gripping comprises oppositely disposed grips on opposite sides of the base member.

13. A device as claimed in claim 9 further including a unidirectional engagement member supported by the tail end holder for engagement with grooves of said cable tic for the purpose of advancing said cable tic.

14. A device as claimed in claim 13 wherein said unidirectional engagement member comprises a pawl finger.

15. A device for securing a cable tie that has head and tail ends, comprising a flexible arc-shaped base member;

a head end holder for receiving the head end of the cable tie and disposed at one end of the arc-shaped base member;

a tail end holder for receiving the tail end of the cable tie and disposed at an opposite end of the arc-shaped base member; and means for gripping the flexible arc-shaped base member to enable opening and closing thereof;

said holders each comprising an open slotted structure for holding the cable tie while enabling removal therefrom once secured.

16. A device as claimed in claim 15 wherein said head end holder has a slot for allowing tail end of cable tie to pass through the holder.

17. A device as claimed in claim 15 wherein said head end holder including means for holding the head end of the cable tie in place as the base member is moved between open and closed positions.

18. A device as claimed in claim 15 wherein said tail end holder has a slot for allowing tail end of cable tie to pass through the holder.

19. A device as claimed in claim 15 wherein said means for gripping the flexible arc-shaped base member are able to encompass a finger or thumb.

20. A device as claimed in claim 17 wherein said means for holding the head end of the cable tie in place on the head end holder prevent head end from passing through the slot in the holder.

* * * * *